US009139983B2

(12) United States Patent
Yoshida et al.

(10) Patent No.: US 9,139,983 B2
(45) Date of Patent: Sep. 22, 2015

(54) CONSTRUCTION MACHINE

(75) Inventors: Hajime Yoshida, Omihachiman (JP); Hajime Ishii, Higashiomi (JP); Syuuhei Noguchi, Higashiomi (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/131,434

(22) PCT Filed: Jul. 9, 2012

(86) PCT No.: PCT/JP2012/067492

§ 371 (c)(1),
(2), (4) Date: Jan. 8, 2014

(87) PCT Pub. No.: WO2013/035425

PCT Pub. Date: Mar. 14, 2013

(65) Prior Publication Data

US 2014/0138177 A1 May 22, 2014

(30) Foreign Application Priority Data

Sep. 7, 2011 (JP) ..... 2011-194852

(51) Int. Cl.
*E02F 9/22* (2006.01)
*E02F 3/32* (2006.01)
*E02F 9/20* (2006.01)

(52) U.S. Cl.
CPC ..... *E02F 9/2235* (2013.01); *E02F 3/325* (2013.01); *E02F 9/2066* (2013.01); *E02F 9/2253* (2013.01)

(58) Field of Classification Search
CPC ..... E02F 9/2253; E02F 9/2235; E02F 9/2066; E02F 3/325; B60P 1/00; B66C 1/00
USPC ..... 180/305, 307
See application file for complete search history.

(56) References Cited

U.S. PATENT DOCUMENTS 7,677,350 B2 * 3/2010 Shirao et al. ..... 180/305
7,712,565 B2 * 5/2010 Udagawa et al. ..... 180/242

(Continued)

FOREIGN PATENT DOCUMENTS

EP 0491944 A1 7/1992
EP 2 336 536 A1 6/2011

(Continued)

OTHER PUBLICATIONS

Extended European Search Report received in corresponding European Application No. 12830151.2 dated Apr. 14, 2015.

*Primary Examiner* — Brodie Follman
*Assistant Examiner* — Brian Cassidy
(74) *Attorney, Agent, or Firm* — Mattingly & Malur, PC

(57) ABSTRACT

An engine (10) electronically controlled by a control device (33), a hydraulic motor (24) for traveling which is driven by a pressurized oil delivered from a hydraulic pump (13), and a traveling speed switching member (29) which switches a traveling speed by the hydraulic motor (24) at least in two stages of a low speed and a high speed. The control device (33) includes an output lowering determination unit for determining whether or not a fuel injection amount to be supplied to the engine (10) is limited and an engine output is in a lowered state and a low-speed control unit in which, when the engine (10) output is in a lowered state, a traveling speed is controlled to a low speed state kept lower than a high speed even if the traveling speed switching member (29) has been switched to the high speed side.

3 Claims, 9 Drawing Sheets

(56) References Cited

U.S. PATENT DOCUMENTS

| | | | | |
|---|---|---|---|---|
| 7,865,288 | B2 * | 1/2011 | Fukushima et al. | 701/54 |
| 8,118,132 | B2 * | 2/2012 | Gray, Jr. | 180/305 |
| 2001/0025736 | A1 * | 10/2001 | Ikari et al. | 180/305 |
| 2006/0096799 | A1 * | 5/2006 | Tatsuno et al. | 180/305 |
| 2010/0154404 | A1 * | 6/2010 | Bitter | 60/459 |
| 2011/0308879 | A1 * | 12/2011 | Shirao et al. | 180/306 |
| 2013/0152574 | A1 * | 6/2013 | Yamazaki et al. | 60/431 |
| 2013/0190960 | A1 * | 7/2013 | Kawashima | 701/22 |
| 2014/0020370 | A1 * | 1/2014 | Berg | 60/327 |
| 2014/0023523 | A1 * | 1/2014 | Berg | 417/53 |

FOREIGN PATENT DOCUMENTS

| | | | |
|---|---|---|---|
| JP | 01-186439 | A | 7/1989 |
| JP | 05-280070 | A | 10/1993 |
| JP | 07-110588 | B2 | 11/1995 |
| JP | 2002-130003 | | 5/2002 |
| JP | 2010-96090 | A | 4/2010 |

* cited by examiner

CONSTRUCTION MACHINE

TECHNICAL FIELD

The present invention relates to a construction machine such as a hydraulic excavator, a hydraulic crane, a wheel loader and the like, for example, and particularly relates to a construction machine which travels on a road by using a hydraulic motor for traveling.

BACKGROUND ART

In general, a construction machine represented by a hydraulic excavator is provided with an automotive vehicle body, an engine mounted on the vehicle body and electronically controlled by a control device, a hydraulic pump which is driven by the engine and sucks an oil liquid in a tank and delivers a pressurized oil, a hydraulic motor for traveling which is driven by the pressurized oil delivered from the hydraulic pump, and a traveling operation device provided on the vehicle body and driving and operating the hydraulic motor during traveling of a vehicle (Patent Document 1).

This type of conventional art construction machine (particularly a small-sized hydraulic excavator called a mini excavator) has a traveling speed switching member for switching a traveling speed of a vehicle by the hydraulic motor. This traveling speed switching member is provided on the front side of an operator's seat of the vehicle body and selectively switches the traveling speed of the vehicle at least in two stages of a low speed and a high speed by manual operation by the operator.

PRIOR ART DOCUMENT

Patent Document

Patent Document 1: Japanese Patent Laid-Open No. Hei 5-280070 A

SUMMARY OF THE INVENTION

In the conventional art construction machine, since an exhaust gas exhausted from the engine needs to be purified, an electronically controlled type engine is mounted in many cases as a recent trend. The electronically controlled engine is affected by fuel properties and/or by a use environment, and a part of a constituent component of the engine might be damaged and enter a bad condition depending on the case. However, in the electronically controlled engine, a protection mode function for protecting an engine main body is added for that case. That is, during operation in the engine protection mode, such control is executed that an injection amount of a fuel is limited so as to lower an engine output so that the bad condition of the engine does not become serious.

However, even if the engine output is lowered in the protection mode operation, if the operator does not notice that and switches the traveling speed switching member to the high-speed stage side, a load of the engine increases. In such case, since the engine enters an overload state, it is concerned that engine stall occurs. Under such situation, if the engine advertently stops, the vehicle cannot travel and cannot move to a place for maintenance represented by a repair shop by itself any longer.

In view of the above described conventional art problem it is an object of the present invention to provide a construction machine which can move by itself to a place where repair is possible by suppressing occurrence of engine stall even if the engine output is lowered and the fuel injection amount is limited.

(1) In order to solve the above described problem, the present invention is applied to a construction machine comprising an automotive vehicle body; an engine mounted on the vehicle body and electronically controlled by a control device; a hydraulic pump which is driven by the engine and sucks an oil liquid in a tank and delivers a pressurized oil; a hydraulic motor for traveling which is driven by the pressurized oil delivered from the hydraulic pump; a traveling operation device provided on the vehicle body and driving and operating the hydraulic motor during traveling; and a traveling speed switching member which is provided on the vehicle body and switches a traveling speed by the hydraulic motor at least in two stages of a low speed and a high speed.

A characteristics of a configuration adopted by the present invention is that the control device includes an output lowering determination unit for determining whether or not a fuel injection amount to be supplied to the engine is limited and an engine output is in a lowered state; and a low-speed control unit in which, when it is determined by the output lowering determination unit that the engine output is in the lowered state, control is executed to a low speed state set in advance to a speed lower than a high speed side traveling speed by an operation of the traveling operation device even if the traveling speed switching member has been switched to the high speed side.

With this arrangement, when it is determined by the output lowering determination unit that the fuel injection amount to be supplied to the engine is limited and the engine output is in the lowered state, the control device for electronically controlling the engine controls the traveling speed of the vehicle to the low speed state set in advance to a speed lower than the high speed side traveling speed by the low-speed control unit. Therefore, even if the traveling speed switching member has been switched to the high speed side, the traveling speed of the vehicle can be kept in the low speed state set in advance when the engine output has lowered, and a load received by the engine as a load pressure of the hydraulic motor for traveling can be kept small. As a result, even in a state in which the engine output of the construction machine has lowered and the fuel injection amount is limited, occurrence of engine stall can be suppressed, and the vehicle can move by itself at a low speed to a place where repair is possible.

(2) According to the present invention, the engine has a configuration in which, in case any one of engine components enters a bad condition, a protection mode operation for lowering the engine output is set, and the output lowering determination unit of the control device is configured to determine whether or not the engine is set to the protection mode operation. As a result, the output lowering determination unit can determine the lowered state of the engine output by whether or not the engine is set to the protection mode operation.

(3) According to the present invention, it is configured such that the hydraulic motor is provided with a motor displacement control mechanism for switching motor displacement at least in two stages of a high speed and a low speed, and the low-speed control unit of the control device executes control of switching the motor displacement control mechanism to the low speed side. As a result, the low-speed control unit can control the traveling speed of the vehicle to the low speed state by switching the motor displacement control mechanism to the low speed side when the engine output lowers even if the traveling speed switching member has been switched to the high speed side.

(4) According to the present invention, it is configured such that in the hydraulic pump, a displacement control mechanism for variably controlling its delivery displacement is provided, and the control device is provided with a small displacement holding unit for holding the delivery displacement of the hydraulic pump to a small displacement state by the displacement control mechanism, when it is determined by the output lowering determination unit that an output of the engine is in the lowered state.

With this arrangement, when the fuel injection amount is limited and the engine output is lowered, the small displacement holding unit of the control device can keep the delivery displacement of the hydraulic pump to the small displacement state by the displacement control mechanism. Therefore, even if the traveling speed switching member has been switched to the high speed side, a flow rate of the pressurized oil to be supplied to the hydraulic motor for traveling can be limited, and the traveling speed of the vehicle can be kept to the low speed state. As a result, when the engine output is lowered, a load received by the engine from the hydraulic pump can be kept small, and occurrence of engine stall can be prevented.

MODE FOR CARRYING OUT THE INVENTION

Figure 1:
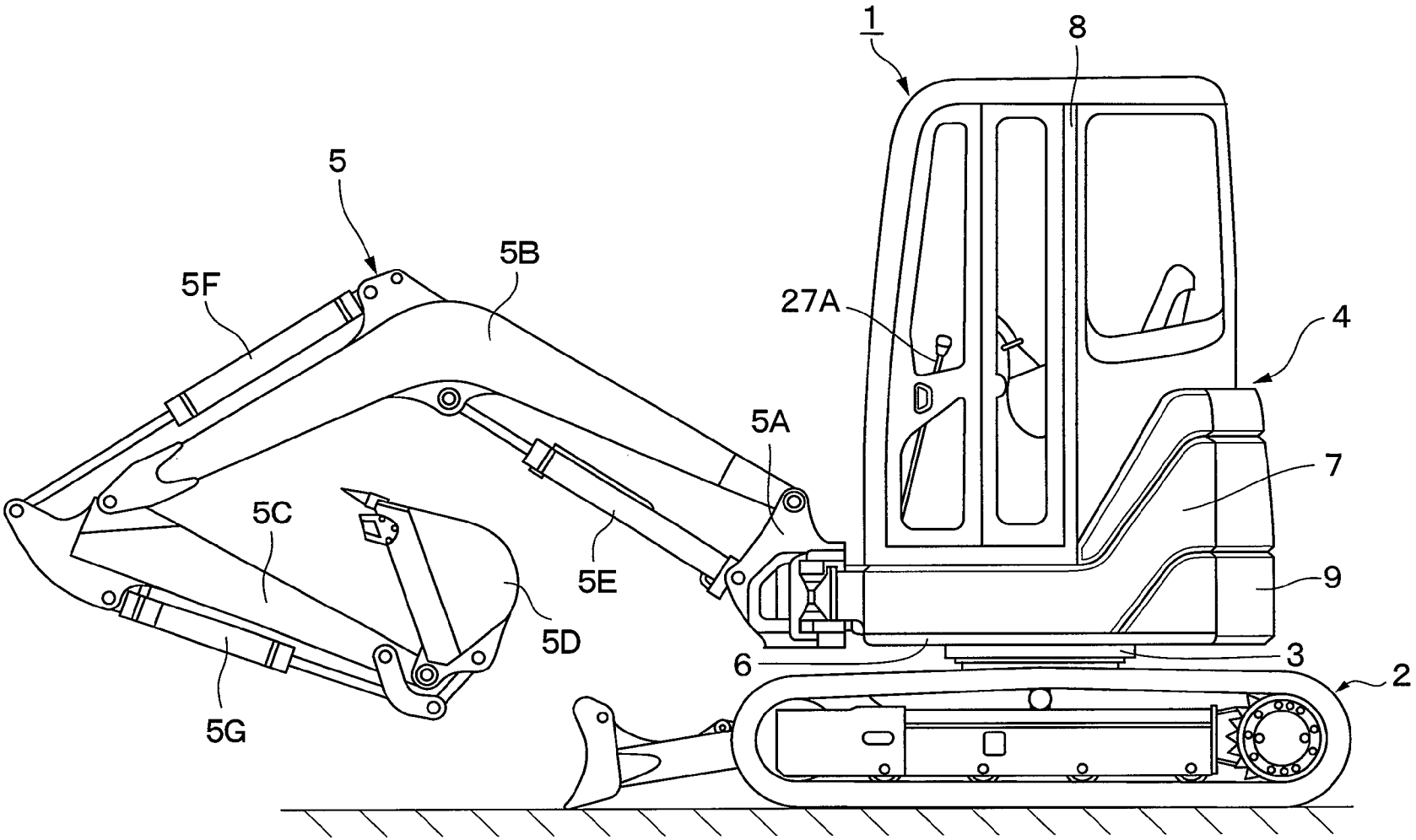
FIG. 1 is a front view showing a hydraulic excavator applied to a first embodiment of the present invention.

Hereinafter, an embodiment of a construction machine according to the present invention will be in detail explained with reference to the accompanying drawings by taking a case in which the construction machine is applied to a small-sized hydraulic excavator.

Here, FIGS. 1 to 6 show a small-sized hydraulic excavator according to a first embodiment of the present invention.

In the figures, designated at 1 is a small-sized hydraulic excavator used for an excavating work of earth and sand and the like. This hydraulic excavator 1 includes an automotive crawler-type lower traveling structure 2, an upper revolving structure 4 rotatably mounted on the lower traveling structure 2 through a revolving device 3 and constituting a vehicle body together with the lower traveling structure 2, and a working mechanism 5 provided capable of moving upward/downward on the front side of the upper revolving structure 4.

Here, the working mechanism 5 is composed as a swing-post type working mechanism and is provided with a swing post 5A, a boom 5B, an arm 5C, a bucket 5D as a working tool, a swing cylinder (not shown), a boom cylinder 5E, an arm cylinder 5F, and a bucket cylinder 5G, for example. Moreover, the upper revolving structure 4 includes a revolving frame 6, an exterior cover 7, a cab 8, and a counterweight 9 which will be described later.

The revolving frame 6 constitutes a part of the upper revolving structure 4, and the revolving frame 6 is mounted on the lower traveling structure 2 through the revolving device 3. In the revolving frame 6, the counterweight 9 and an engine 10 which will be described later are provided on its rear part side, and the cab 8 which will be described later is provided on the left front side. Moreover, in the revolving frame 6, the exterior cover 7 is provided at a position between the cab 8 and the counterweight 9, and this exterior cover 7 defines a machine chamber accommodating the engine 10 therein together with the revolving frame 6, the cab 8, and the counterweight 9.

The cab 8 is mounted on the left front side of the revolving frame 6, and the cab 8 defines an operator's cabin on which the operator gets inside. Inside the cab 8, an operator's seat on which the operator is seated and various operation levers (only a traveling lever 27A which will be described later is shown in FIG. 3) are disposed.

Figure 2:
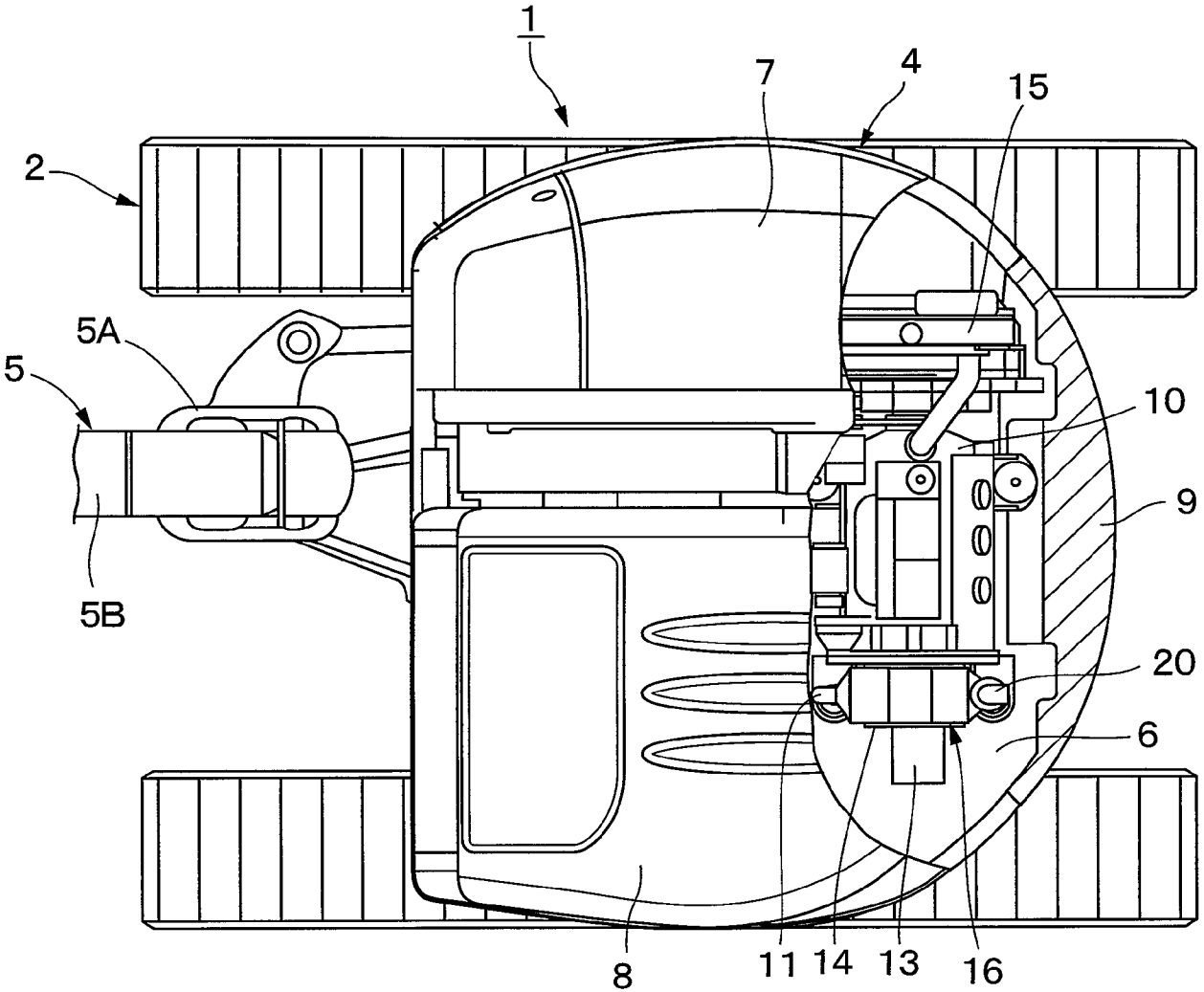
FIG. 2 is a partially broken plan view showing the hydraulic excavator in a state in which a part of a cab and an exterior cover of an upper revolving structure in FIG. 1 is removed in an enlarged manner.

The counterweight 9 constitutes a part of the upper revolving structure 4, and the counterweight 9 is located on the rear side of the engine 10 which will be described later and mounted on a rear end portion of the revolving frame 6 and is to take a weight balance with the working mechanism 5. As shown in FIG. 2, the rear surface side of the counterweight 9 is formed having an arc shape and is constituted so as to make a revolving radius of the upper revolving structure 4 small.

Designated at 10 is the engine arranged in a laterally placed state on the rear side of the revolving frame 6, and since the engine 10 is mounted as a prime mover on the small-sized hydraulic excavator 1 as described above, it is constituted by using a small-sized diesel engine, for example. As shown in FIG. 2, on the left side of the engine 10, an exhaust pipe 11 constituting a part of an exhaust gas passage is provided, and an exhaust gas purifying device 16 which will be described later is connected and provided to the exhaust pipe 11.

Figure 3:
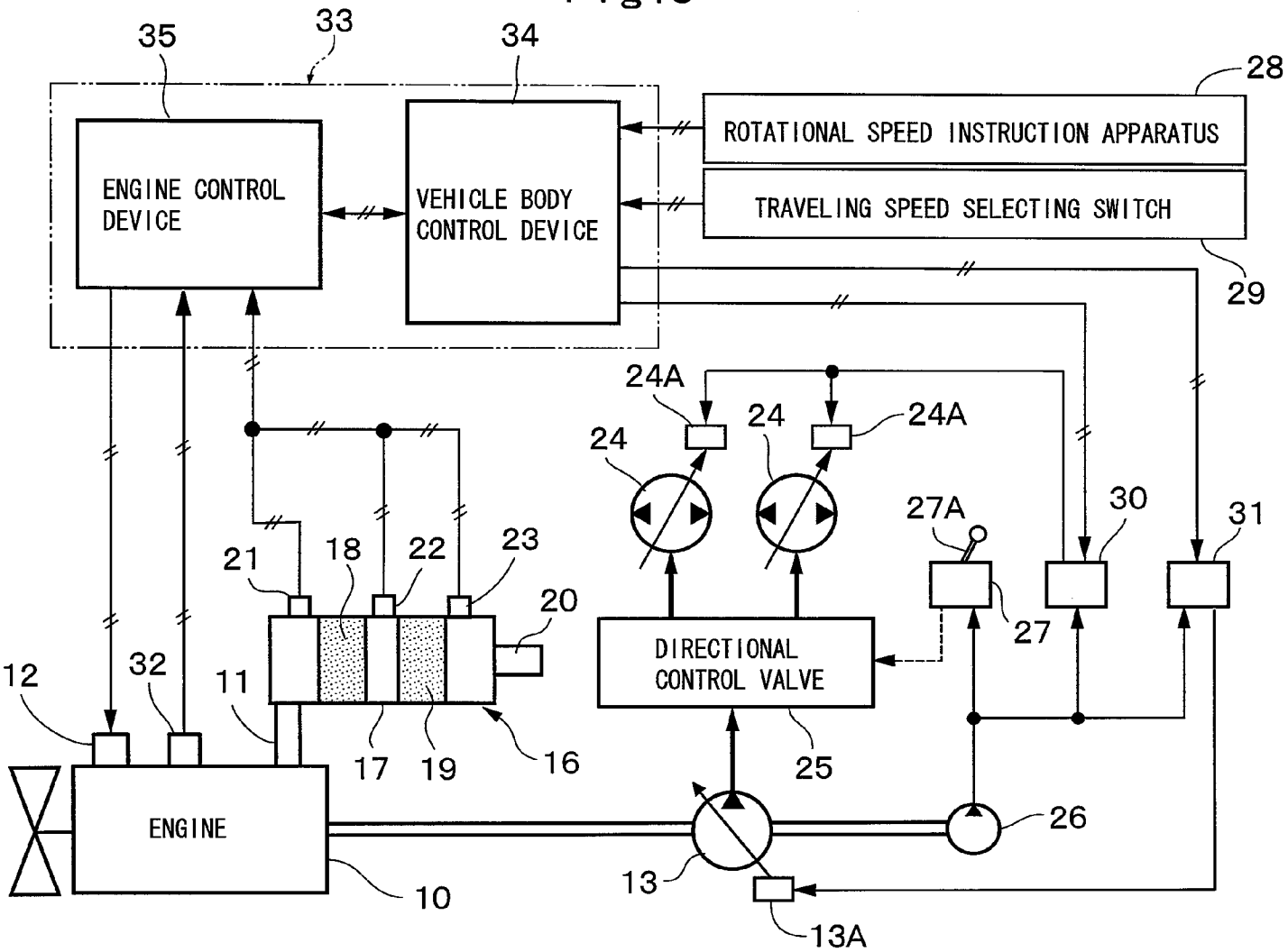
FIG. 3 is an entire configuration diagram showing an engine, a hydraulic pump, a directional control valve, a hydraulic motor for traveling, and an engine control device.

Here, the engine 10 is constituted by an electronically controlled engine, and a fuel supply amount is variably controlled by an electronic governor 12 (See FIG. 3). That is, this electronic governor 12 variably controls a fuel injection amount to be supplied to the engine 10 on the basis of a control signal outputted from an engine control device 35 which will be described later. As a result, the rotational speed of the engine 10 is controlled so as to become a rotational speed corresponding to a target rotational speed by the control signal.

The hydraulic pump 13 is provided on the left side of the engine 10, and the hydraulic pump 13 constitutes a hydraulic pressure source together with an operating oil tank (not shown). The hydraulic pump 13 is constituted by a variable displacement type swash plate type, a bent axis type or a radial piston type hydraulic pump, for example. The hydraulic pump 13 is provided with a pump displacement variable portion 13A as a displacement control mechanism, and the pump displacement variable portion 13A is constituted by a tilting actuator including a hydraulic cylinder. The pump displacement variable portion 13A controls the delivery displacement of the hydraulic pump 13 by switching between the two stages of large displacement and small displacement in accordance with the control signal (a pilot pressure for displacement control) from a pump tilting switching valve 31 which will be described later.

As shown in FIG. 2, the hydraulic pump 13 is mounted on the left side of the engine 10 through a power transmission device 14, and a rotational output of the engine 10 is transmitted by this power transmission device 14. When the hydraulic pump 13 is driven by the engine 10, the hydraulic pump 13 sucks an oil liquid in the operating oil tank and delivers a pressurized oil toward a directional control valve 25 which will be described later.

A heat exchanger 15 is provided on the revolving frame 6 at a position on the right side of the engine 10, and this heat exchanger 15 includes a radiator, an oil cooler, and an intercooler, for example. That is, the heat exchanger 15 is to cool the engine 10 and is also to cool the pressurized oil (operating oil) to be returned to the operating oil tank.

Designated at 16 is the exhaust gas purifying device for removing and purifying a harmful substance contained in the exhaust gas of the engine 10. As shown in FIG. 2, this exhaust gas purifying device 16 is disposed in the vicinity of the engine 10 and also, on the upper side of the power transmission device 14. To the exhaust gas purifying device 16, the exhaust pipe 11 of the engine 10 is connected to the upstream side thereof. The exhaust gas purifying device 16 constitutes an exhaust gas passage together with the exhaust pipe 11 and removes the harmful substance contained in this exhaust gas while the exhaust gas flows from the upstream side to the downstream side.

That is, the engine 10 composed of a diesel engine has high efficiency and excellent durability. However, the exhaust gas of the engine 10 contains harmful substances such as particulate matters (PM), nitrogen oxides (NOx), carbon monoxide (CO) and the like. Thus, the exhaust gas purifying device 16 mounted on the exhaust pipe 11 includes an oxidation catalyst 18 which oxidizes and removes carbon monoxide (CO) and a particulate matter removing filter 19 which catches and removes the particulate matter (PM), which will be described later, respectively.

As shown in FIG. 3, the exhaust gas purifying device 16 has a cylindrical casing 17 constituted by connecting a plurality of cylindrical bodies detachably on the front and the rear. In the casing 17, the oxidation catalyst 18 (usually called Diesel Oxidation Catalyst or DOC in abbreviation) and the particulate matter removing filter 19 (usually called Diesel Particulate Filter or abbreviated as DPF) are removably accommodated.

The oxidation catalyst 18 is formed of a cell-shaped cylindrical body made of ceramics and having an outer diameter dimension equal to an inner diameter dimension of the casing 17, and a large number of through holes (not shown) are formed in the axial direction thereof, whose inner surface is coated with precious metal. The oxidation catalyst 18 makes the exhaust gas flow through each of the through holes at a predetermined temperature and oxidizes and removes carbon monoxide (CO) and hydrocarbon (HC) contained in the exhaust gas and removes nitrogen oxides (NO) as nitrogen dioxide (NO2).

The particulate matter removing filter 19 is arranged on the downstream side of the oxidation catalyst 18 in the casing 17. The particulate matter removing filter 19 catches particulate matters (PM) in the exhaust gas exhausted from the engine 10 and burns and removes the caught particulate matters so as to purify the exhaust gas. Thus, the particulate matter removing filter 19 is constituted by a cell-shaped cylindrical body in which a large number of small holes (not shown) are provided in the axial direction in a porous member made of a ceramics material, for example. Therefore, the particulate matter removing filter 19 catches the particulate matters through the large number of small holes, and the caught particulate matters are burned and removed as described above. As a result, the particulate matter removing filter 19 is regenerated.

A discharge port 20 of the exhaust gas is provided on the downstream side of the exhaust gas purifying device 16. This discharge port 20 is located on the downstream side from the particulate matter removing filter 19 and is connected to an outlet side of the casing 17. The discharge port 20 includes a funnel for emitting the exhaust gas after purification processing to the atmospheric air, for example.

An exhaust gas temperature sensor 21 is to detect a temperature of the exhaust gas, and the exhaust gas temperature sensor 21 is mounted on the casing 17 of the exhaust gas purifying device 16 and detects a temperature of the exhaust gas exhausted from the exhaust pipe 11 side, for example. The temperature detected by the exhaust gas temperature sensor 21 is outputted to the engine control device 35 which will be described later as a detection signal.

Gas pressure sensors 22 and 23 are provided on the casing 17 of the exhaust gas purifying device 16. As shown in FIG. 3, these gas pressure sensors 22 and 23 are arranged on the upstream side (inlet side) and the downstream side (outlet side) of the particulate matter removing filter 19, separated away from each other and outputs the respective detection signals to the engine control device 35 which will be described later.

The engine control device 35 calculates a pressure difference ΔP from an upstream side pressure P1 detected by the gas pressure sensor 22 and a downstream side pressure P2 detected by the gas pressure sensor 23 in compliance with the following formula 1. Moreover, the engine control device 35 estimates deposited amounts of the particulate matter and unburned residues adhering to the particulate matter removing filter 19, that is, a caught amount from a calculation result of the pressure difference ΔP. In this case, the pressure difference ΔP becomes a small pressure value when the caught amount is small and becomes a higher pressure value as the caught amount increases.

$$\Delta P = P1 - P2 \quad \text{[Formula 1]}$$

Left and right traveling motors 24 are driven by the pressurized oil delivered from the hydraulic pump 13. The left and right traveling motors 24 are constituted by the hydraulic motor provided on the lower traveling structure 2 of the hydraulic excavator 1. Each of the traveling motors 24 is provided with a motor displacement variable portion 24A as a motor displacement control mechanism, and the motor displacement variable portion 24A is constituted by a tilting actuator made of a hydraulic cylinder. The motor displacement variable portion 24A is to control the rotational speed of the traveling motor 24 by switching at least between two stages of a low speed and a high speed in compliance with a signal from a traveling speed switching valve 30 (pilot pressure for tilting control) which will be described later.

It should be noted that a plurality of hydraulic actuators (none of them is shown) are provided in the hydraulic excavator 1 in addition to the hydraulic motor 24. The hydraulic actuator mounted on the hydraulic excavator 1 includes the swing cylinder (not shown) of the working mechanism 5, the boom cylinder 5E, the arm cylinder 5F or the bucket cylinder 5G (See FIG. 1), for example. Moreover, these hydraulic actuators include a hydraulic motor for revolving and an elevation cylinder for blade (none of them is shown).

The directional control valve 25 is a control valve for the traveling motor 24. This directional control valve 25 is provided between the hydraulic pump 13 and each of the traveling motors 24, respectively, and variably controls a flow rate and a direction of the pressurized oil to be supplied to each of the traveling motors 24. That is, each of the directional control valves 25 is switched from a neutral position to left or right switched position (none of them is shown) by supply of the pilot pressure from a traveling operation valve 27 which will be described later. It should be noted that the directional control valves 25 are provided one each on each of the left and right traveling motors 24, totaling in two, but they are collectively shown as one in FIG. 3.

A pilot pump 26 is an auxiliary hydraulic pump constituting an auxiliary hydraulic pressure source together with the operating oil tank. This pilot pump 26 is rotated and driven along with the main hydraulic pump 13 by the engine 10. The pilot pump 26 is to deliver the operating oil sucked from the inside of the operating oil tank toward the traveling operation valve 27 which will be described later.

Designated at 27 is the traveling operation valve as a traveling operating device, and the traveling operation valve 27 is constituted by a pressure-reduction valve type pilot operation valve. The traveling operation valve 27 is provided in the cab 8 (See FIG. 1) of the upper revolving structure 4 and has the traveling lever 27A tilted and operated by the operator. The traveling operation valve 27 is arranged in two corresponding to the directional control valves 25 for individual remote control of the left and right traveling motors 24. That is, when the operator tilts and operates the traveling lever 27A, each of the traveling operation valves 27 supplies a pilot pressure corresponding to the operated amount to a hydraulic pilot portion (not shown) of each of the directional control valves 25.

As a result, the directional control valve 25 is switched to either one of the switched positions from the neutral position. When the directional control valve 25 is switched to either one of the switched positions, the pressurized oil from the hydraulic pump 13 is supplied in one direction, and the traveling motor 24 is rotated and driven in an applicable direction (in a forward direction, for example). On the other hand, if the directional control valve 25 is switched to the other switched position, the pressurized oil from the hydraulic pump 13 is supplied in the other direction, and the traveling motor 24 is rotated and driven in an opposite direction (in a backward direction, for example).

A rotational speed instruction apparatus 28 is to instruct a target rotational speed of the engine 10 and this rotational speed instruction apparatus 28 is provided in the cab 8 (See FIG. 1) of the upper revolving structure 4. The rotational speed instruction apparatus 28 is composed of any one of an operation dial operated by the operator, an up/down switch or an engine lever (none of them is shown). The rotational speed instruction apparatus 28 is to output an instruction signal of the target rotational speed according to the operation by the operator to a vehicle body control device 34 which will be described later.

A traveling speed selecting switch 29 is to select a traveling speed of the hydraulic excavator 1. This traveling speed selecting switch 29 is to switch the traveling speed of the vehicle (hydraulic excavator 1) in two stages of a low speed and a high speed and is a specific example of the traveling speed switching member which is a constituent element of the invention of the present application. The traveling speed selecting switch 29 is provided in the cab 8 (See FIG. 1) of the upper revolving structure 4 and switches the traveling speed of the vehicle in the two stage of a low speed and a high speed by manual operation by the operator. The traveling speed selecting switch 29 outputs a selection signal (that is, a selection signal of a low speed or a high speed) at this time to the vehicle body control device 34 which will be described later.

The traveling speed switching valve 30 is to variably control the rotational speed of the traveling motor 24. This traveling speed switching valve 30 outputs a signal for switching the motor displacement (pilot pressure for tilting control) to the motor displacement variable portion 24A of each of the traveling motors 24 in accordance with the control signal outputted from the vehicle body control device 34 which will be described later. Each of the motor displacement variable portions 24A switches the rotational speed of each of the traveling motors 24 in the two stages of a low speed and a high speed in accordance with the pilot pressure outputted from the traveling speed switching valve 30.

That is, the traveling speed switching valve 30 is ON/OFF controlled in accordance with the control signal from the vehicle body control device 34. When the traveling speed switching valve 30 is turned ON and opened, the pilot pressure from the pilot pump 26 is supplied to the motor displacement variable portion 24A. As a result, the motor displacement variable portion 24A makes a tilting angle of the traveling motor 24 small and switches the rotational speed to the high-speed side. When the traveling speed switching valve 30 is turned OFF and closed, supply of the pilot pressure to the motor displacement variable portion 24A is stopped. As a result, the motor displacement variable portion 24A executes control of increasing the tilting angle of the traveling motor 24 and of switching the rotational speed to the low speed side.

Designated at 31 is a pump tilting switching valve as a displacement control mechanism for variably controlling a delivery displacement of the hydraulic pump 13. This pump tilting switching valve 31 outputs a signal for switching a pump displacement (pilot pressure for tilting control) in accordance with the control signal outputted from the vehicle body control device 34 which will be described later to the pump displacement variable portion 13A of the hydraulic pump 13 and increases/decreases the delivery displacement of the hydraulic pump 13.

That is, the pump tilting switching valve 31 is ON/OFF controlled in accordance with the control signal from the vehicle body control device 34. When the pump tilting switching valve 31 is turned ON and opened, the pilot pressure from the pilot pump 26 is supplied to the pump displacement variable portion 13A. As a result, the pump displacement variable portion 13A makes the tilting angle of the hydraulic pump 13 small and decreases the delivery displacement (a flow rate of the pressurized oil delivered from the hydraulic pump 13). While the pump tilting switching valve 31 is OFF and closed, supply of the pilot pressure to the pump displacement variable portion 13A is stopped. As a result, the pump displacement variable portion 13A makes the tilting angle of the hydraulic pump 13 large and increases the delivery displacement.

A rotational sensor 32 is to detect a rotational speed of the engine 10, and the rotational sensor 32 outputs a detection signal of an engine rotational speed N to the engine control device 35. The engine control device 35 monitors an actual rotational speed of the engine 10 on the basis of the detection signal of the engine rotational speed N and controls the engine rotational speed N so that the actual rotational speed gets close to the target rotational speed instructed by the rotational speed instruction apparatus 28, for example.

Subsequently, a control device 33 used in the first embodiment will be described.

That is, designated at 33 is the control device of the hydraulic excavator 1, and the control device 33 includes the vehicle body control device 34 and the engine control device 35. The vehicle body control device 34 outputs a control signal for variably controlling the rotational speed of the traveling motor 24 to the traveling speed switching valve 30 in accordance with a signal outputted from the rotational speed instruction apparatus 28 and the traveling speed selecting switch 29. On the other hand, the vehicle body control device 34 outputs a control signal for variably controlling the delivery displacement of the hydraulic pump 13 to the pump tilting switching valve 31.

The vehicle body control device 34 has a storage portion (not shown) composed of a ROM, a RAM, and a nonvolatile memory, and this storage portion stores a processing program for executing traveling speed control when the engine output lowers shown in FIG. 6 which will be described later, that is, control for preventing engine stall (hereinafter referred to as engine stall prevention control). Moreover, the vehicle body control device 34 also has a function of outputting an instruction signal for instructing a target rotational speed of the engine 10 to the engine control device 35 in accordance with the signal outputted from the rotational speed instruction apparatus 28.

The engine control device 35 executes predetermined calculation processing determined in advance on the basis of the instruction signal outputted from the vehicle body control device 34 and the detection signal of the engine rotational speed N outputted from the rotational sensor 32 and outputs a control signal for instructing a target fuel injection amount to the electronic governor 12 of the engine 10. The electronic governor 12 of the engine 10 increases or decreases the fuel injection amount to be injected and supplied into a combustion chamber (not shown) of the engine 10 in accordance with the control signal or stops injection of the fuel. As a result, the rotational speed of the engine 10 is controlled so as to become a rotational speed corresponding to the target rotational speed instructed by the instruction signal from the vehicle body control device 34.

The engine control device 35 has its input side connected to the exhaust gas temperature sensor 21, the gas pressure sensors 22 and 23, the rotational sensor 32, the vehicle body control device 34 and the like and has its output side connected to the electronic governor 12 of the engine 10, the vehicle body control device 34 and the like. Moreover, the engine control device 35 has a storage portion (not shown) composed of a ROM, a RAM, and a nonvolatile memory, and this storage portion stores a processing program for controlling the engine rotational speed N.

Figure 4:
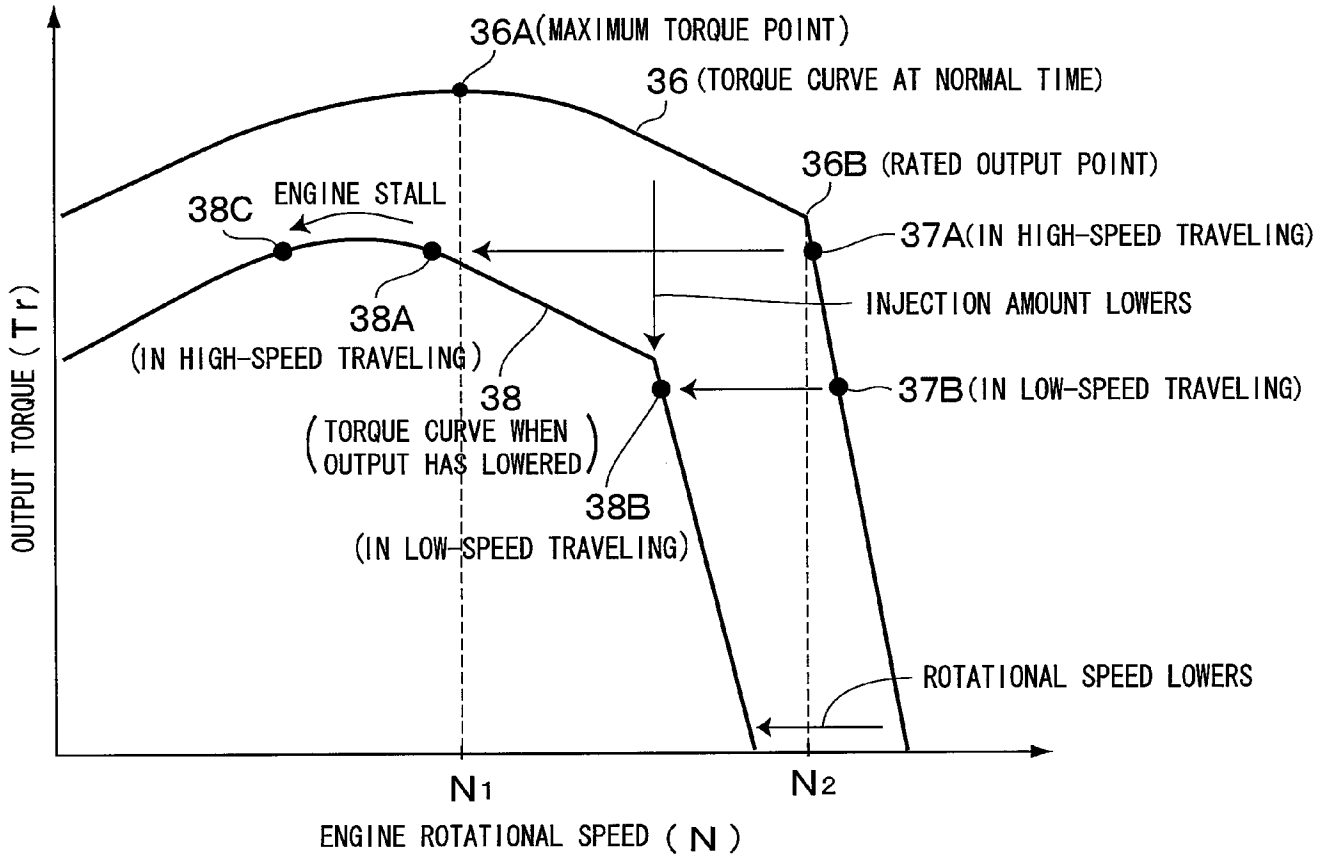
FIG. 4 is a characteristic diagram showing a relationship between an engine rotational speed and an output torque as torque curves during normal time and when the output is lowered.

Here, an output torque Tr of the engine 10 has a torque characteristic as a characteristic line 36 shown in FIG. 4 with respect to the engine rotational speed N during normal operation. During this normal operation, when the engine rotational speed N is a rotational speed N1, the output torque Tr of the engine 10 becomes a maximum torque point 36A, and the engine rotational speed N becomes a rotational speed N2 (N2>N1) at a rated output point 36B.

Thus, during the normal operation, if the traveling speed of the hydraulic excavator 1 (vehicle) is set to the high-speed stage, the engine 10 is operated at a position of an output point 37A where the output torque Tr is smaller than that at the rated output point 36B. On the other hand, if the traveling speed of the vehicle is set to the low-speed stage, the engine 10 is operated at a position of an output point 37B where the output torque Tr is smaller than that at the output point 37A.

The electronically controlled engine 10 might be affected by fuel properties and/or a use environment, and a part of engine components (including the above described exhaust gas temperature sensor 21, the gas pressure sensors 22 and 23, the rotational sensor 32, the fuel injection valve, and a water temperature sensor, for example) might be damaged and enter a bad condition depending on the case. Thus, in the electronically controlled engine 10, a protection mode function for protecting the engine main body is added in such case.

That is, in the protection mode operation of the engine 10, the fuel injection amount which can be supplied by the electronic governor 12 toward the combustion chamber of the engine 10 is limited. Here, the characteristic line 38 shown in FIG. 4 shows a torque curve when an output lowers in the protection mode operation of the engine 10. As described above, in case of the protection mode operation of the engine 10, the output torque Tr of the engine 10 lowers, and the engine rotational speed N also lowers.

As in the characteristic line 38 shown in FIG. 4, in a state in which the engine output lowers in the protection mode operation, if the traveling speed of the vehicle is set to the high-speed stage, the engine 10 is operated at the position of the output point 38A where the output torque Tr is substantially equal to the output point 37A during the above described normal operation. On the other hand, if the traveling speed of the vehicle is set to the low-speed stage, the engine 10 is operated at the position of the output point 38B where the output torque Tr is substantially equal to the output point 37B during the normal operation.

In this case, if the engine 10 is to be operated with the traveling speed of the vehicle set to the low-speed stage and the output torque Tr at the position of the output point 38B, engine stall will not occur. However, if the traveling speed of the vehicle is set to the high-speed stage, the engine 10 is operated with the output torque Tr at the position of the output point 38A. Thus, if an excessive torque acts instantaneously in moving at start of the vehicle, the output torque Tr moves from the position of the output point 38A to the output point 38C, and it is highly likely that engine stall occurs.

Figure 5:
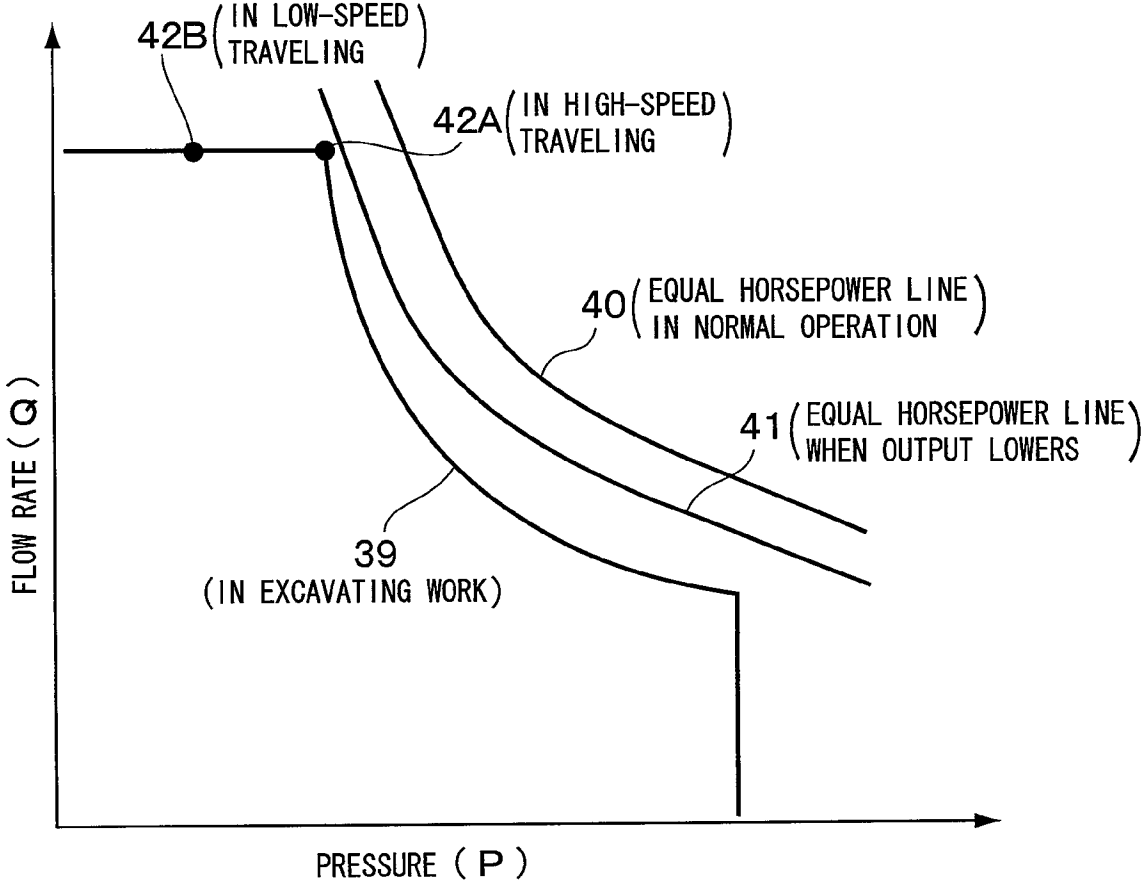
FIG. 5 is a characteristic diagram showing a relationship between a delivery pressure and a flow rate of the hydraulic pump.

FIG. 5 shows P-Q (pressure-flow rate) characteristic of the hydraulic pump 13 during an excavating work of the hydraulic excavator 1. That is, the hydraulic pump 13 during the excavating work is driven so that a delivery pressure (P) and a delivery flow rate (Q) are controlled within a range of the characteristic line 39 shown in FIG. 5. A characteristic line 40 shows a horsepower curve of the engine 10 in the normal operation, and a characteristic line 41 shows a horsepower curve in the state in which the engine output lowers.

If the traveling speed of the vehicle is set to the high-speed stage, a relationship between the delivery pressure P and the delivery flow rate Q of the hydraulic pump 13 can be expressed as a position of a point 42A in the characteristic line 39 in FIG. 5, for example. On the other hand, if the traveling speed is set to the low-speed stage, the relationship between the delivery pressure P and the flow rate Q of the hydraulic pump 13 can be expressed as a point 42B, for example.

The hydraulic excavator 1 according to the first embodiment has the configuration as above and subsequently, its operation will be explained.

The operator of the hydraulic excavator 1 gets on the cab 8 of the upper revolving structure 4, starts the engine 10 and drives the hydraulic pump 13 and the pilot pump 26. As a result, the pressurized oil is delivered from the hydraulic pump 13, and this pressurized oil is supplied to the left and right traveling motors 24 through the directional control valve 25. On the other hand, from the directional control valves (not shown) other than that, the pressurized oil is supplied to the other hydraulic actuators (a hydraulic motor for revolving, the boom cylinder 5E, the arm cylinder 5F, the bucket cylinder 5G or other hydraulic cylinders, for example).

When the operator having gotten on the cab 8 operates the traveling lever 27A, the pressurized oil from the hydraulic pump 13 is supplied to the left and right traveling motors 24 through the directional control valve 25, and each of the traveling motors 24 is rotated and driven. As a result, the lower traveling structure 2 of the hydraulic excavator 1 is driven to run, and the vehicle can be move forward or backward. Moreover, by operating the operation lever for work by the operator in the cab 8, the working mechanism 5 can be moved upward/downward and an excavating work of earth and sand can be performed.

During an operation of the engine 10, the particulate matter which is a harmful substance is discharged from its exhaust pipe 11. At this time, the exhaust gas purifying device 16 can oxidize and remove hydrocarbon (HC), nitrogen oxides (NO), and carbon monoxide (CO) in the exhaust gas by the oxidation catalyst 18, for example. On the other hand, the particulate matter removing filter 19 catches the particulate matter contained in the exhaust gas and burns and removes (regenerates) the caught particulate matter. As a result, the purified exhaust gas can be discharged to the outside through the discharge port 20 on the downstream side.

By the way, the electronically controlled engine 10 for executing purifying processing of the exhaust gas is affected by fuel properties and/or a use environment, and a part of components of the engine 10 might be damaged and enter a bad condition depending on the case. Thus, in the electronically controlled engine 10, the protection mode function for protecting the engine main body is added in such case. In the protection mode operation of the engine 10, the fuel injection amount by the electronic governor 12 is limited so as to lower the engine output, whereby an advertent operation stop of the engine 10 is prevented. However, even if the engine output has lowered in the protection mode operation, if the operator does not notice that and switches the traveling speed selecting switch 29 to the high speed side, a load of the engine 10 increases and becomes an overload state, and it is concerned that engine stall occurs.

Figure 6:
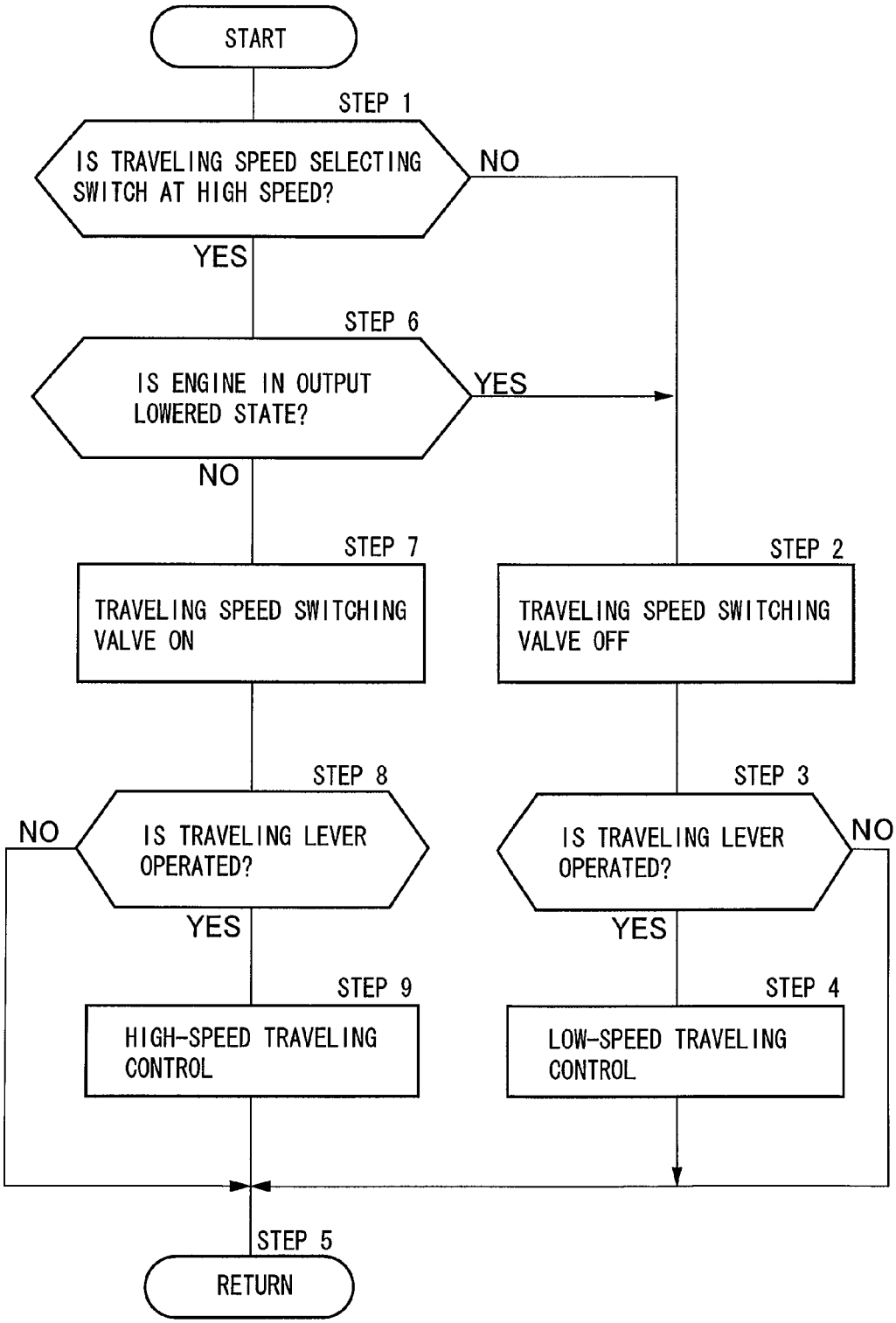
FIG. 6 is a flowchart showing traveling speed control processing when the engine output is lowered according to the first embodiment.

Thus, the first embodiment is configured such that engine stall prevention control of the engine 10 according to a program shown in FIG. 6, that is, the traveling speed control processing when the output of the engine 10 has lowered is executed in the control device 33 composed of the vehicle body control device 34 and the engine control device 35.

Step 6 in the program shown in FIG. 6 is an output lowering determination unit which is a constituent element of the present invention, and this output lowering determination unit determines whether or not the fuel injection amount to be supplied to the engine 10 is limited and the engine output is in the lowered state. On the other hand, in case the determination processing at Step 6 is determined to be "YES", the processing at Steps 2 to 4 is the low-speed control unit which is a constituent element of the present invention. This low-speed control unit executes processing of controlling the traveling speed in operation of the traveling operation valve 27 in a low speed state in which the traveling speed is kept lower than a high speed even if the traveling speed selecting switch 29 is switched to the high speed side.

In the processing of controlling the traveling speed in the low speed state by the low-speed control unit, in which the traveling speed is kept lower than a high speed, not only a low-speed rotation if the traveling speed selecting switch 29 is switched to the low speed side but a low-speed rotation other than that may be set in advance. It should be noted that, in the explanation of the following first embodiment, the low-speed rotation if the traveling speed selecting switch 29 is switched to the low speed side will be explained as a typical example.

That is, when a processing operation in FIG. 6 is started by operation of the engine 10, at Step 1, it is determined whether or not the traveling speed selecting switch 29 has been switched to the high speed side. While it is determined to be "NO" at Step 1, since the traveling speed selecting switch 29 has been switched to the low speed side, a load pressure generated in the traveling motor 24 can be kept to a pressure lower than a pressure value at which engine stall can easily occur, for example.

While the traveling speed selecting switch 29 is switched to the low speed side, the engine 10 is operated at the position of the output point 37B in traveling at a low speed as the characteristic line 36 during normal operation shown in FIG. 4, and the output torque Tr at this time is a value smaller than the output point 37A in a high-speed traveling. Moreover, if nonconformity occurs in the component of the engine 10, the protection mode operation in which the fuel injection amount by the electronic governor 12 is limited is performed. However, even during such protection mode operation (that is, in a state in which the output torque Tr of the engine 10 lowers as the characteristic line 38 shown in FIG. 4), while the traveling speed selecting switch 29 is switched to the low speed side, since the engine 10 is operated with the output torque Tr at the position of the output point 38B, engine stall does not occur.

At the subsequent Step 2, the traveling speed switching valve 30 is turned OFF and closed, and supply of the pilot pressure to the motor displacement variable portion 24A is stopped. As a result, the motor displacement variable portion 24A executes control of increasing the tilting angle of the traveling motor 24 and of switching the rotational speed to the low speed side.

At Step 3, it is determined whether or not the traveling lever 27A is operated, and while it is determined to be "YES", low-speed traveling control is executed at the subsequent Step 4, and the traveling motor 24 is driven at the low speed stage so as to travel and drive the vehicle in a low speed state. Moreover, while it is determined to be "NO" at Step 3, the traveling lever 27 is returned to the neutral position without operating the traveling lever 27A by the operator, control of stopping the traveling operation of the vehicle is executed, and the routine returns at the subsequent Step 5.

On the other hand, if it is determined to be "YES" at Step 1, since the traveling speed selecting switch 29 has been switched to the high speed side, at the subsequent Step 6, it is determined whether the engine output has lowered in the engine 10 in the protection mode operation. If it is determined to be "NO" at Step 6, since the engine 10 is operated in the normal mode, as the characteristic line 36 shown in FIG. 4, operation of the engine 10 can be continued at the position of the output point 37A in the high-speed traveling.

At the subsequent Step 7, the traveling speed switching valve 30 is turned ON and opened, and the pilot pressure from the pilot pump 26 is supplied to the motor displacement variable portion 24A. As a result, the motor displacement variable portion 24A executes control of decreasing the tilting angle of the traveling motor 24 and of switching the rotational speed to the high speed side.

At Step 8, it is determined whether or not the traveling lever 27A is operated, and while it is determined to be "YES", the high-speed traveling control is executed at the subsequent Step 9, and the traveling motor 24 is driven at the high-speed stage so as to travel and drive the vehicle at a high speed state. Moreover, while it is determined to be "NO" at Step 8, the traveling lever 27 is returned to the neutral position without operating the traveling lever 27A by the operator, control of stopping the traveling operation of the vehicle is executed, and the routine returns at the subsequent Step 5.

However, if it is determined to be "YES" at Step 6, the engine output has lowered as the characteristic line 38 in FIG. 4 in the protection mode operation of the engine 10. Thus, even if the traveling speed selecting switch 29 has been switched to the high speed side, control of keeping the traveling speed of the vehicle in the low speed state is executed. That is, in this case, the routine proceeds to Step 2, and the traveling speed switching valve 30 is turned OFF and closed, and supply of the pilot pressure to the motor displacement variable portion 24A is stopped. As a result, the motor displacement variable portion 24A executes control of increasing the tilting angle of the traveling motor 24 and of switching the rotational speed to the low speed side and subsequently continues control at Step 3 and after.

According to the first embodiment, even if the traveling speed selecting switch 29 has been switched to the high speed side, the traveling speed of the vehicle can be kept in the low speed state when the engine output lowers, and a load received by the engine 10 from the hydraulic pump 13 as a load pressure of the traveling motor 24 can be kept small.

Therefore, according to the first embodiment, even if the engine output of the hydraulic excavator 1 lowers and the fuel injection amount is limited, by keeping the traveling speed of the vehicle in the low speed state, occurrence of engine stall can be suppressed. As a result, the hydraulic excavator 1 can be moved while being self-propelled at a low speed to a repair shop or a place for maintenance, and the subsequent repair work can be performed smoothly.

Figure 7:
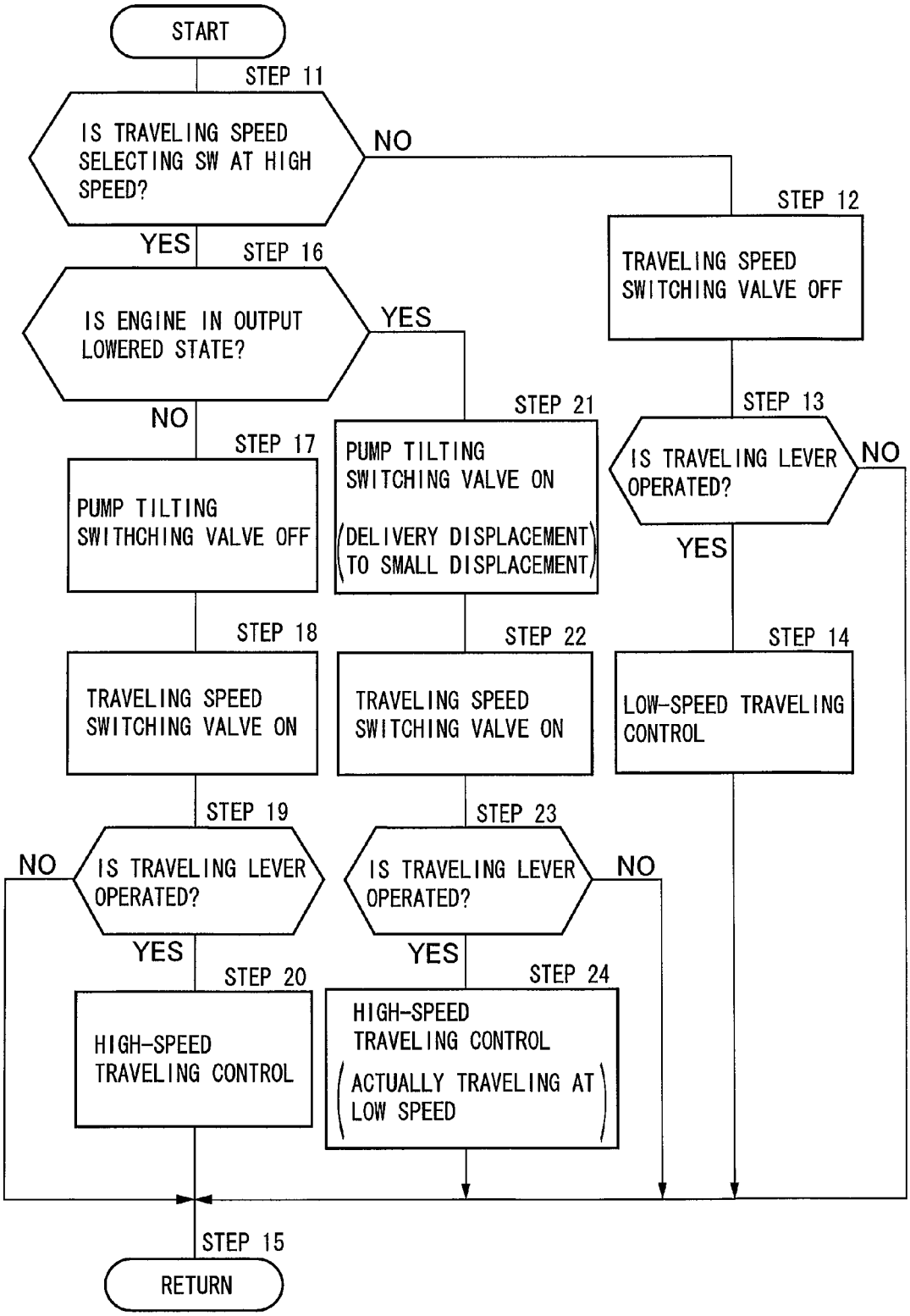
FIG. 7 is a flowchart showing the traveling speed control processing when the engine output is lowered according to a second embodiment.
Figure 8:
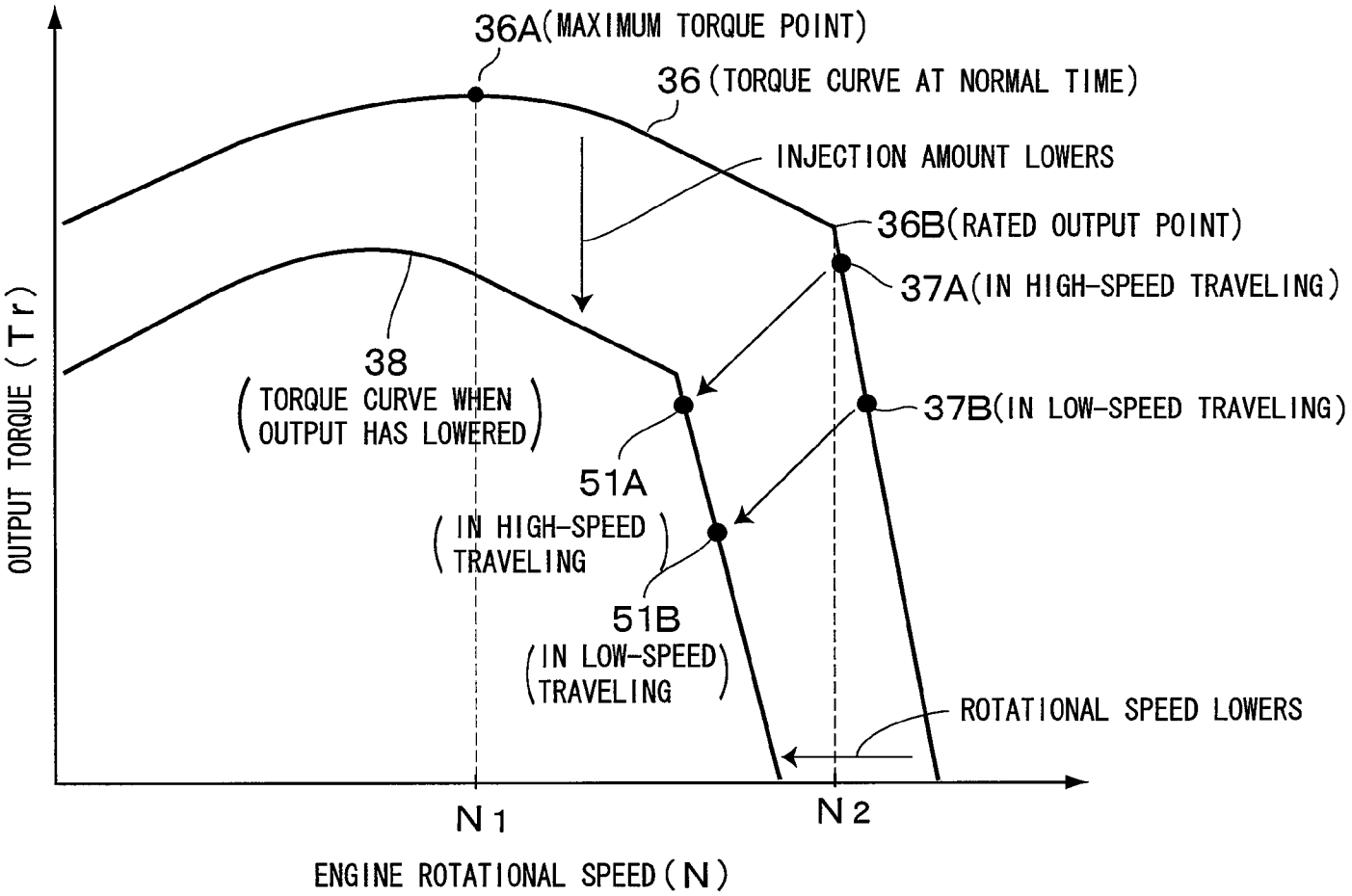
FIG. 8 is a characteristic diagram showing a relationship between an engine rotational speed and an output torque according to the second embodiment as torque curves during normal time and when the output is lowered.
Figure 9:
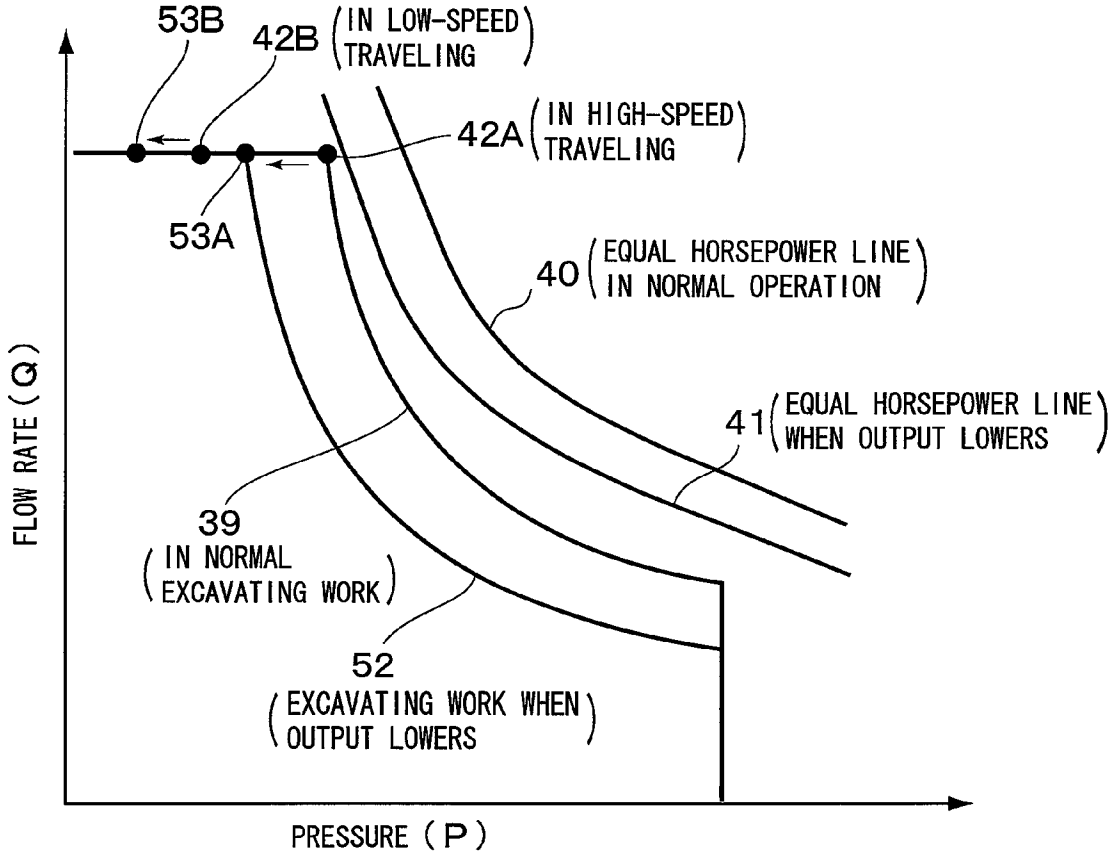
FIG. 9 is a characteristic diagram showing a relationship between a delivery pressure and a flow rate of the hydraulic pump according to the second embodiment.

Subsequently, FIGS. 7 to 9 show a second embodiment of the present invention. In the second embodiment, component elements that are identical to those in the foregoing first embodiment will be simply denoted by the same reference numerals to avoid repetitions of similar explanations. However, a feature of the second embodiment is a configuration in which, if the fuel injection amount is limited and the engine output lowers, the delivery displacement of the hydraulic pump 13 is switched to a small displacement state by the pump displacement variable portion 13A (See FIG. 3).

Here, when a processing operation shown in FIG. 7 is started, processing from Step 11 to Step 16 is executed similarly to Step 1 to Step 6 shown in FIG. 6 in the first embodiment. If it is determined to be "NO" at Step 16, since the engine 10 is operated in the normal mode, as the characteristic line 36 shown in FIG. 8, the operation of the engine 10 can be continued at the position of the output point 37A in the high-speed traveling.

At the subsequent Step 17, the pump tilting switching valve 31 is turned OFF and closed, and supply of the pilot pressure to the pump displacement variable portion 13A is stopped. As a result, the pump displacement variable portion 13A keeps the tilting angle of the hydraulic pump 13 in a large state, and sets the delivery displacement of the hydraulic pump 13 to a large displacement state. It should be noted that the hydraulic pump 13 in this case may be considered in the delivery displacement state similar to the control processing shown in FIG. 6 according to the first embodiment. Subsequent processing at Step 18 to Step 20 is executed similarly to Step 7 to Step 9 shown in FIG. 6 according to the first embodiment.

On the other hand, in case it is determined to be "YES" at Step 16, the engine output has lowered as indicated by the characteristic line 38 in FIG. 8 in the protection mode operation of the engine 10. Thus, even if the traveling speed selecting switch 29 has been switched to the high speed side, control of keeping the traveling speed of the vehicle in the low speed state as a result is executed by switching the delivery displacement of the hydraulic pump 13 to a small displacement.

That is, at the subsequent Step 21, the pump tilting switching valve 31 is turned ON and opened, and the pilot pressure from the pilot pump 26 is supplied to the pump displacement variable portion 13A. As a result, the pump displacement variable portion 13A executes control of decreasing the tilting angle of the hydraulic pump 13 and of switching the delivery displacement to the small displacement side. Thus, the characteristic of the hydraulic pump 13 during the excavating work, for example, lowers to a characteristic line 52 when the output lowers (protection mode) from the characteristic line 39 in the normal mode shown in FIG. 9.

At the subsequent Step 22, since the traveling speed selecting switch 29 has been switched to the high speed side by the determination processing at the above described Step 11, the traveling speed switching valve 30 is turned ON and opened, and the pilot pressure from the pilot pump 26 is supplied to the motor displacement variable portion 24A. As a result, the motor displacement variable portion 24A executes control of decreasing the tilting angle of the traveling motor 24 and of switching the rotational speed to the high speed side.

However, in this case, since the delivery displacement of the hydraulic pump 13 has been switched to the small displacement side, even if the engine output lowers as the characteristic line 38 in FIG. 8 in the protection mode operation of the engine 10, the engine 10 is operated in a state in which the output torque Tr of the engine 10 has been moved from the output point 37A in the high-speed traveling to an output point 51A. Thus, in the engine 10, a load from the hydraulic pump 13 does not enter the overload state, and engine stall does not occur.

That is, it is determined at the subsequent Step 23 whether or not the traveling lever 27A is operated, and while it is determined to be "YES", the high-speed traveling control is executed at the subsequent Step 24, and the traveling motor 24 is driven in the high-speed stage. However, since the delivery displacement of the hydraulic pump 13 has been set to the small displacement, only apparent high-speed traveling control is executed, and the vehicle actually travels in a low speed state. Moreover, while it is determined to be "NO" at Step 23, the traveling lever 27A is returned to the neutral position without operating the traveling lever 27A by the operator, control of stopping the traveling operation of the vehicle is executed, and the routine returns at the subsequent Step 15.

On the other hand, while the engine 10 is operated in a state in which the engine output lowers in the protection mode, as long as the traveling speed selecting switch 29 is switched to the low speed side, it is determined to be "NO" at Step 11. Thus, at the subsequent Step 12, the traveling speed switching valve 30 is turned OFF and closed, and supply of the pilot pressure to the motor displacement variable portion 24A is stopped. As a result, the motor displacement variable portion 24A executes control of increasing the tilting angle of the traveling motor 24 and of switching the rotational speed to the low speed side, and the low-speed traveling control is executed at Step 14.

In this case, since the delivery displacement of the hydraulic pump 13 has been switched to the small displacement side, in the state in which the engine output lowers as the characteristic line 38 in FIG. 8, the engine 10 is operated in a state in which the output torque Tr of the engine 10 has moved from the output point 37B in the low-speed traveling to an output point 51B. Thus, in the engine 10, the load from the hydraulic pump 13 does not enter the overload state, and engine stall does not occur.

As shown in FIG. 9, if the traveling speed of the vehicle is set to the high-speed stage, the relationship between the delivery pressure P and the delivery flow rate Q of the hydraulic pump 13 is changed from the position of the point 42A in the normal operation to the position of the point 53A in the protection mode operation. On the other hand, if the traveling speed is set to the low-speed stage, the relationship between the delivery pressure P and the delivery flow rate Q of the hydraulic pump 13 is changed from the position of the point 42B in the normal operation to a position of a point 53B in the protection mode operation.

Thus, in the second embodiment configured as above, too, when the fuel injection amount of the engine 10 is limited, and the engine output lowers, by switching the delivery displacement of the hydraulic pump 13 to the small displacement by the pump displacement variable portion 13A, occurrence of engine stall can be prevented, and the effects similar to those in the first embodiment can be obtained.

Particularly, in the second embodiment, when the engine output lowers, by switching the delivery displacement of the hydraulic pump 13 to the small displacement, the traveling speed of the vehicle can be kept in the low speed state. Thus, even if the high speed side is selected by the traveling speed selecting switch 29, and the traveling motor 24 has been switched to the high-speed stage, the traveling speed of the vehicle can be kept in a low speed state.

It should be noted that, in the above described first embodiment, the determination processing at Step 6 shown in FIG. 6 shows a specific example of the output lowering determination unit which is a constituent element of the present invention. Moreover, the processing at Step 2 to Step 4 if it is determined to be "YES" at Step 6 shows a specific example of the low-speed control unit. On the other hand, in the second embodiment, the determination processing at Step 16 shown in FIG. 7 shows a specific example of the output lowering determination unit which is a constituent element of the present invention. Moreover, the processing at Step 21 shows a specific example of a small displacement keeping unit.

In the above described first embodiment, the example in which the hydraulic pump 13 is configured by a variable displacement type hydraulic pump is explained. However, in the first embodiment, since the delivery displacement of the hydraulic pump 13 does not have to be changed, a fixed displacement type swash plate type, bent axis type or radial piston type hydraulic pump, for example, may be used.

In the above described first embodiment, the example in which the traveling speed of the vehicle (hydraulic excavator 1) is switched in two stages of a low speed and a high speed by the traveling speed selecting switch 29 was explained as a specific example of the traveling speed switching member. However, the present invention is not limited to that, and the construction machine may be configured such that the traveling speed of the vehicle is switched in three stages or four stages or more between a low speed and a high speed, for example. Moreover, as the traveling speed switching member, in addition to the switching switch represented by the traveling speed selecting switch 29, other operating members such as a speed switching lever, a rotation type dial and the like may be used. In any case, any configuration may be used as long as the traveling speed of the vehicle is set to the low speed state when the engine output lowers. This point also applies to the second embodiment.

In the above described first embodiment, in the processing at Step 2 to Step 4 if it is determined to be "YES" at Step 6 in FIG. 6 (a low-speed control unit), the processing for keeping the traveling speed of the vehicle in the low speed state is explained as an example. However, the present invention is not limited to the low-speed rotation which is the same as a case in which the traveling speed selecting switch 29 has been switched to the low speed side as described above. That is, it may be so configured that control is executed at a desired low-speed rotation set lower than a high speed set by the traveling speed selecting switch 29. This point also applies to the second embodiment.

In each of the above described embodiments, the hydraulic excavator 1 provided with the swing-post type working mechanism 5 is explained as an example. However, the construction machine according to the present invention is not limited to that and may be applied to a hydraulic excavator provided with an offset boom type working mechanism in which a boom is composed of a lower boom and an upper boom, for example. Moreover, the present invention may be applied to a hydraulic excavator provided with a general mode working mechanism called a normal mono-boom type composed of a boom, an arm, and a bucket (working tool).

Moreover, in each of the above described embodiments, the small-sized hydraulic excavator 1 is explained as an example of the construction machine. However, the construction machine according to the present invention is not limited to that, and the construction machine may be a hydraulic excavator of a medium size or more, for example. Moreover, the present invention can be widely applied, to construction machines including a hydraulic excavator provided with a wheel-type lower traveling structure, a wheel loader, a forklift, a hydraulic crane, and a dump truck.

DESCRIPTION OF REFERENCE NUMERALS

1: Hydraulic excavator
2: Lower traveling structure (Vehicle body)
4: Upper revolving structure (Vehicle body)
5: Working mechanism
6: Revolving frame (Frame)
9: Counterweight
10: Engine
11: Exhaust pipe
12: Electronic governor
13: Hydraulic pump
13A: Pump displacement variable portion (Displacement control mechanism)
15: Heat exchanger
16: Exhaust gas purifying device
17: Casing
18: Oxidation catalyst
19: Particulate matter removing filter
21: Exhaust gas temperature sensor
22, 23: Gas pressure sensor
24: Traveling motor (Hydraulic motor)
24A: Motor displacement variable portion (Motor displacement control mechanism)
25: Directional control valve
26: Pilot pump
27: Traveling operation valve (Traveling operating device)
27A: Traveling lever (Operation lever)
28: Rotational speed instruction apparatus
29: Traveling speed selecting switch (Traveling speed switching member)
30: Traveling speed switching valve
31: Pump tilting switching valve

32: Rotational sensor
33: Control device
34: Vehicle body control device
35: Engine control device

The invention claimed is:

1. A construction machine comprising:

an automotive vehicle body;

an engine mounted on said vehicle body;

a control device which electronically controls said engine;

a hydraulic pump which is provided with a displacement control mechanism to variably control delivery displacement of said hydraulic pump, and which is driven by said engine to deliver a pressurized oil;

a hydraulic motor for traveling of the vehicle body and which is driven by the pressurized oil delivered from said hydraulic pump;

a traveling operation device provided on said vehicle body, to drive and operate said hydraulic motor during traveling; and a traveling speed switching member-which is provided on said vehicle body and switches a traveling speed of said hydraulic motor between at least two stages of a low speed and a high speed, wherein said control device includes:

an output lowering determination unit for determining whether or not a fuel injection amount to be supplied to said engine is limited and an engine output is in a lowered state; and a low-speed control unit in which, when it is determined by said output lowering determination unit that said engine output is in the lowered state, control is executed to set a predetermined low speed state having a speed lower than said high speed by an operation of said traveling operation device even if said traveling speed switching member has been switched to said high speed, wherein said low-speed control unit has a small displacement holding unit to hold the delivery displacement of said hydraulic plump in a small displacement state by said displacement control mechanism, when it is determined by said output lowering determination unit that an output of said engine is in the lowered state for keeping said traveling speed at the speed of said predetermined low speed state.

2. The construction machine according to claim 1, wherein said engine has a configuration in which, in case any one of engine components enters a bad condition, a protection mode operation for lowering said engine output is set, and said output lowering determination unit of said control device is configured to determine whether or not said engine is set to the protection mode operation.

3. The construction machine according to claim 1, wherein said hydraulic motor is provided with a motor displacement control mechanism to switch motor displacement between at least two stages of a high speed and a low speed, and said low-speed control unit executes control of switching said motor displacement control mechanism to the low speed stage.

* * * * *